United States Patent [19]

Nakamura et al.

[11] 4,025,588

[45] May 24, 1977

[54] CARBURETORS UTILIZING AN ACCELERATION PUMP AND A METHOD THEREFOR

[75] Inventors: Norihiko Nakamura, Mishima; Hiromichi Yanagihara, Susono, both of Japan

[73] Assignee: Toyota Jidosha Kogyo Kabushiki Kaisha, Toyota, Japan

[22] Filed: Oct. 7, 1975

[21] Appl. No.: 620,491

[30] Foreign Application Priority Data

June 19, 1975 Japan ..... 50.74271

[52] U.S. Cl. ..... 261/34 A; 417/540

[51] Int. Cl.[2] ..... F02M 7/08

[58] Field of Search ..... 261/34 A; 417/540

[56] References Cited

UNITED STATES PATENTS

| | | | |
|---|---|---|---|
| 2,133,033 | 10/1938 | Messinger, Jr. | 261/34 A |
| 2,183,636 | 12/1939 | Berry | 261/34 A |
| 2,363,223 | 11/1944 | Bonnier | 261/34 A |
| 2,417,734 | 3/1947 | Carlson et al. | 261/34 A |
| 2,785,880 | 3/1957 | Olson | 261/34 A |
| 2,824,725 | 2/1958 | Dietrich | 261/34 A |
| 2,908,363 | 10/1959 | Dietrich et al. | 261/34 A |
| 3,192,864 | 7/1965 | Notte | 417/540 |
| 3,210,011 | 10/1965 | Barosko | 417/540 |
| 3,298,675 | 1/1967 | Miano | 261/34 A |
| 3,437,081 | 4/1969 | Mennesson | 261/34 A |

*Primary Examiner*—Tim R. Miles

*Attorney, Agent, or Firm*—Finnegan, Henderson, Farabow & Garrett

[57] ABSTRACT

A carburetor utilizing an acceleration pump, acting in conjunction with the throttle valve, to supply fuel through an injection channel to the fuel-air mixture chamber. A fuel accumulator contains a diaphragm under bias forming a diaphragm chamber of predetermined volume connected to the injection channel by a branch channel, a portion of the fuel supplied by the acceleration pump being diverted to the diaphragm chamber against the bias. The diverted fuel is fed to the fuel-air mixture chamber when the bias exceeds the pressure from the pump and the proportion of fuel diverted is controlled by the relative sizes of the open areas in restrictors positioned in the outlet of the injection channel into the fuel-air mixture chamber and of the branch channel into the diaphragm chamber, the strength of the bias and the maximum deformation of the diaphragm being adjustable.

17 Claims, 3 Drawing Figures

CARBURETORS UTILIZING AN ACCELERATION PUMP AND A METHOD THEREFOR

BACKGROUND OF THE INVENTION

1. Field of the Invention

This invention relates to a carburetor having an acceleration pump. More particularly, the invention relates to a carburetor having an acceleration pump in which the amount of fuel injected into the fuel-air mixture chamber is adjusted to conform more closely with the rotation rate of the engine.

2. Description of the Prior Art

In an acceleration pump of a carburetor for preventing an acceleration lag in an automobile, the piston of the acceleration pump acting with the throttle valve is moved vertically to inject fuel contained in a cylinder into the fuel-air mixture chamber of the carburetor through an injection channel and an restrictor mounted in the end of the injection channel. According to this conventional method, the rate of fuel injection is determined exclusively by the force on the piston, and hence, it is impossible to control and adjust the amount of fuel injected in accordance with the rate of rotation of the internal-cumbustion engine.

More specifically, since injection of fuel is conducted regardless of the rate of rotation of the engine whether at the initial injector stage at a low rate of rotation or at the later injection stage at a high rate of rotation, an excess of fuel is injected at the initial stage and the injection of fuel is insufficient at the later stage. Because of this defect, improvement of the accelerating capacity is limited, and at the initial stage incomplete combustion is caused owing to excessive injection of fuel. Harmful gases such as CO and hydrocarbons are generated by this incomplete combustion.

SUMMARY OF THE INVENTION

It is therefore a primary object of this invention to provide a carburetor having an acceleration pump, which can overcome the foregoing defects involved in conventional techniques and in which the amount of fuel injected is adjusted to conform more closely to the requirements of the engine as determined by its rotational rate.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the invention comprises an improvement in a carburetor having an acceleration pump, acting in conjunction with the throttle valve of the carburetor, for injecting fuel into the fuel-air mixture chamber of the carburetor through an injection channel containing an injection restrictor in the opening of the injection channel into the fuel-air mixture chamber, the improvement comprising a fuel accumulator containing a diaphragm under bias forming a diaphragm chamber in the accumulator, a branch channel interconnecting said diaphragm chamber to said injection channel between said acceleration pump and said injection restrictor, and a connection channel between said diaphragm chamber and a fuel supply, said connecting channel including a check valve.

The invention consists in the novel parts, constructions, arrangements, combinations and improvements shown and described. The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENT OF THE INVENTION

Reference will now be made in detail to the present preferred embodiment of the invention an example of which is illustrated in the accompanying drawings.

Figure 1:
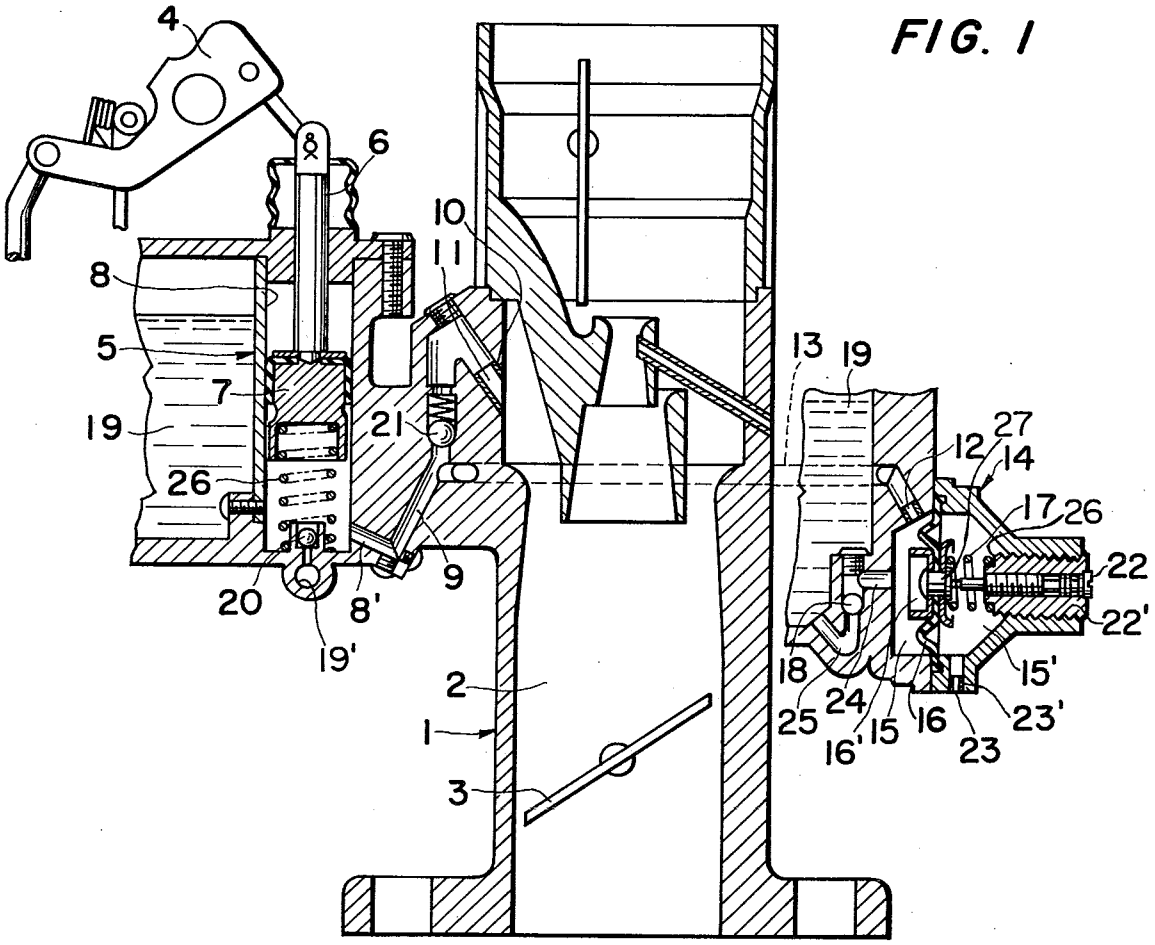
FIG. 1 is a sectional view illustrating the preferred embodiment of the carburetor provided with an acceleration pump and constructed according to the teachings of this invention.

Referring to FIG. 1, in accordance with the invention a piston rod 6 of an acceleration pressure pump 5 is connected by known means (not shown) to a throttle valve 3 in the fuel-air mixture chamber 2 of the carburetor 1 through a linkage 4. The piston rod 6 is connected to a piston 7 slidably mounted in a cylinder 8, the piston 7 being biased toward a negative pressure position by a spring 26.

As herein embodied, the cylinder 8 communicates with a fuel chamber 19 through a check ball 20 and a passage 19′, (the connection of the passage 19′ to the fuel chamber 19 not being shown). The cylinder 8 also communicates with the fuel-air mixture chamber 2 through an injection channel 9 formed in the inner wall of the carburetor 1, and entering the cylinder 8 through its side wall channel 8′. The injection channel 9 enters the fuel-air mixture chamber 2 through a restrictor 10 in an injection opening 11. An acceleration checking ball valve 21 is positioned in the injection channel 9 below the restrictor 10 acting to be opened when the piston 7 is acting against the force of the spring 26.

In accordance with the invention, an accumulator 14 mounted on the outer wall of the carburetor 1 includes a diaphragm chamber 15 and a pressure chamber 15′ separated by a diaphragm 16. The diaphragm chamber 15 is connected to the injection channel 9 between the injection opening 8′ and the ball valve 21 by a branch channel 13 having a restrictor 12 therein at its entry into the diaphragm chamber. The diaphragm chamber 15 also communicates with the fuel chamber 19 through a fuel feed connection 25 by an opening 24 in the wall of the diaphragm chamber. The fuel feed connection 25 contains a ball check valve 18 to prevent fuel from flowing backwardly from the diaphragm chamber 15 to the fuel chamber 19.

As shown in FIG. 1, piston 16′ is mounted on the diaphragm 16 substantially in the center thereof and in the diaphragm chamber. The diaphragm 16 and piston 16′ are under bias pressure from a spring 17 in the pressure chamber 15′ tending to maintain a predetermined volume for the diaphragm chamber 15, the bias pressure and the maximum deformation of the diaphragm being adjustable. The adjustment of the maximum deformation of the diaphragm 16 is achieved by a screw means 22 mounted in a screw support means 22' threaded into the wall of the accumulator 14. The screw support means 22' has a shoulder 26 on its inner end, the spring 17 being positioned between the diaphragm 16 and the shoulder 26.

As herein embodied, the compression of the spring 17 can be changed by the rotation of the screw support means 22'. The maximum deformation of the diaphragm 16 can be defined by varying the length of the screw means 22 extending into the pressure chamber 15', the diaphragm abutting against the end of the screw means at maximum deformation.

In the preferred embodiment the piston 16' is mounted by a support 27 extending through the diaphragm 16 and the end of the screw means 22 abuts against the piston support 27 upon the maximum deformation of the diaphragm.

Figure 3:
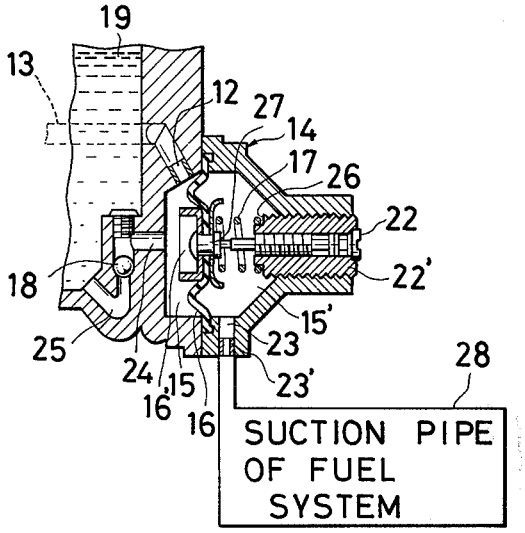
FIG. 3 is a partial view illustrating an alternative embodiment of the accumulator of FIG. 1.

The pressure chamber 15' of the accumulator 14 communicates with the outer air through a channel 23 containing a restrictor 23'. In some uses of the invention it may be desirable, alternatively, for the channel 23, with its restrictor 23' to be connected with the negative pressure of a suction pipe in the fuel system 28 of the engine as shown in FIG. 3.

The operation of the carburetor of this invention having the above structure at the acceleration step will now be described. When the opening of the throttle valve 3 corresponds to a constant driving speed, the pressure on the piston 7, through the linkage 4, is released, as is known in the art, and the piston 7 of the acceleration pump 3 is pushed upwardly by the spring 26 mounted on the bottom of the cylinder. The check ball valve 20 is opened and fuel fills the available space in the cylinder 8 and the injection channel 9 to the level of the acceleration-checking ball valve 21.

Further, the check ball valve 18 of the feed connection channel 25 of the accumulator 14 is opened and facilitates the rapid filling with fuel of the diaphragm chamber 15 of the accumulator 14 and the branch channel 13. When the acceleration pump system is thus filled with fuel, the check ball valves 18 and 20 are closed.

In this state, as herein embodied, if the opening of the throttle valve 3 is increased for acceleration, the piston 7 acting with the throttle valve 3 is actuated against the bias of the spring 26. The fuel in the cylinder 8 and the injection channel 9 is therefore fed to the fuel-air mixture chamber 2 of the carburetor and to the diaphragm chamber 15 of the accumulator 14 through the branch channel 13. Since the restrictor 10 is disposed in the injection channel 9 at the injection opening 11 into the fuel-air mixture chamber 2 and the restrictor 12 is disposed in the branch channel 13 at the point where the branch channel is connected to the diaphragm chamber 15, the injected fuel receives resistance from the restrictors 10 and 12 and pressure on the fuel is elevated. The ratio of the fuel fed to the fuel-air mixture chamber 2 to the fuel fed to the diaphragm chamber 15 is determined by the sizes of the restrictors 10 and 12 and the pressure increases in the diaphragm chamber 15 which corresponds to the compression deformation of the spring 17.

In accordance with the invention, since the pressure on the fuel in the diaphragm chamber 15 is thus increased, the diaphragm 16 presses and deforms the spring 17 to increase the volume of the diaphragm chamber 15. A portion of fuel from acceleration pump in an amount corresponding to this increase of the volume together with the fuel which has been already contained in the diaphragm chamber 15 are therefore, stored in the chamber 15 under pressure.

When the injection operation of the piston 7 is completed to cease feeding fuel from the cylinder 8, the pressure in the injection channel 9 is reduced, and the diaphragm 16, acting under the force of the spring 17, is restored to its original position. The amount of fuel corresponding to the increase brought about by the deformation of the diaphragm 16 is, therefore, fed to the branch channel 13 and injected into the fuel-air mixture chamber 2.

Figure 2:
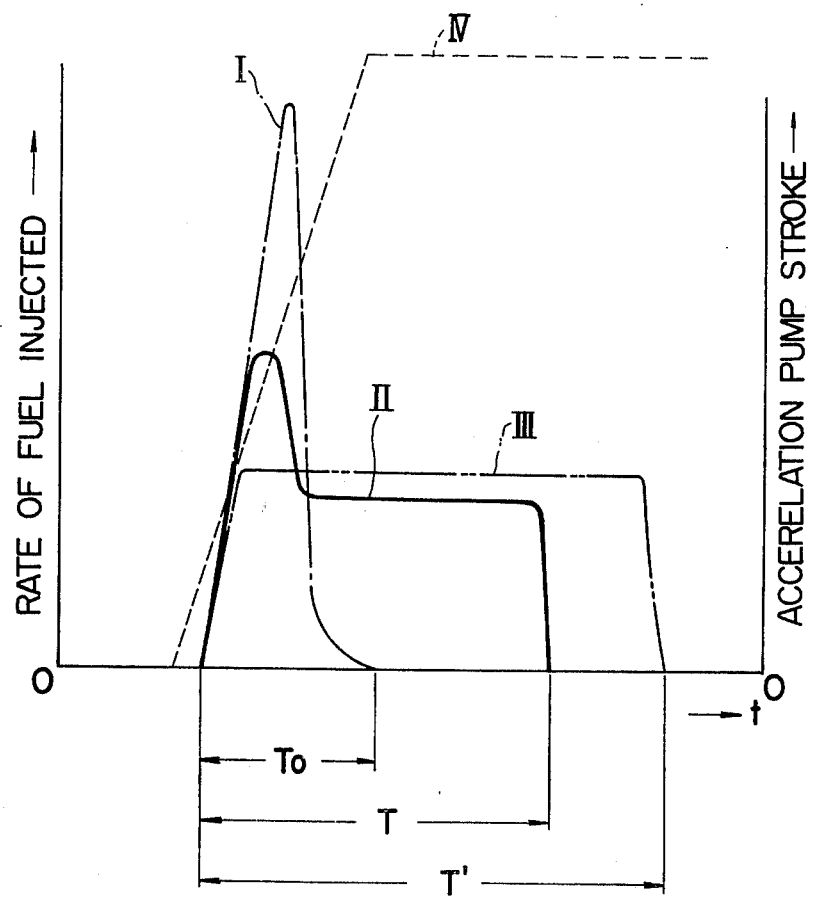
FIG. 2 is a graph illustrating comparative pressure characteristics in the injection passage with the carburetor of FIG. 1.

According to the present invention, an ideal pressure characteristic curve is obtained in the injection channel 9. More specifically, as is illustrated in FIG. 2, the pressure characteristic curve II obtained according to the present invention is more ideal than the pressure characteristic curve I obtained according to the conventional technique. In FIG. 2, the pressure characteristic curve III is one obtained when no restrictor 12 is provided in the branch channel 13. Curve IV represents a stroke of acceleration pump during acceleration. As is seen in FIG. 2, in the case of the pressure characteristic curves II or III, the change of the pressure with the lapse of the injection time is made smaller and more level than in the case of the pressure characteristic curve I, and the injection time can be prolonged according to the present invention (the injection time To in the conventional technique is prolonged to T or T' according to the present invention).

Accordingly, injection of fuel for acceleration can be prolonged and during this prolonged period, the rate of rotation of the internal-combustion engine is increased and the negative pressure of an air suction pipe, if utilized, is increased, whereby feeding of a desired quantity of fuel from the main system can be attained. Further, the amount of fuel injected is controlled and adjusted appropriately also at the initial stage of injection and hence, formation of harmful gases as CO and hydrocarbons can be greatly reduced.

It will be apparent to those skilled in the art that various modifications and variations could be made in the containers of the invention without departing from the scope or spirit of the invention.

What is claimed is:

1. In a carburetor having an acceleration pump, acting in conjunction with the throttle valve of the carburetor, for injecting fuel into the fuel-air mixture chamber of the carburetor through an injection channel containing an injection restrictor in the opening of the injection channel into the fuel-air mixture chamber, the improvement comprising:

a fuel accumulator containing a diaphragm under bias forming a diaphragm chamber in the accumulator, a branch channel interconnecting said diaphragm chamber to said injection channel between said acceleration pump and said injection restrictor, and a connection channel between said diaphragm chamber and a fuel supply, said connection channel including a check valve.

2. The carburetor improvement of claim 1 also including a restrictor in said branch channel proximate said diaphragm chamber.

3. The carburetor improvement of claim 1 also including means for adjusting the bias on said diaphragm.

4. The carburetor improvement of claim 1 also including means for defining the maximum deformation of said diaphragm.

5. The carburetor improvement of claim 1 wherein the carburetor is in the fuel system of an engine, the fuel system having a suction pipe, said diaphragm also forms a pressure chamber on the side of said diaphragm opposite said diaphragm chamber and said pressure chamber of said accumulator communicates with the outer air or the negative pressure of the suction pipe in the fuel system of the engine.

6. In a carburetor having an acceleration pump, acting in conjunction with the throttle valve of the carburetor, for injecting fuel into the fuel-air mixture chamber of the carburetor through an injection channel containing an injection restrictor in the opening of the injection channel into the fuel-air mixture chamber, the improvement comprising:

a fuel accumulator containing a diaphragm forming a diaphragm chamber in the accumulator.

a branch channel interconnecting said diaphragm chamber to said injection channel between said acceleration pump and said injection restrictor, a restrictor in said branch channel proximate said diaphragm chamber, means for biasing said diaphragm toward a predetermined volume of said diaphragm chamber, means for adjusting said biasing means, means for defining the maximum deformation of said diaphragm, and thereby the maximum increased volume of said diaphragm chamber, and a connection channel between said diaphragm chamber and a fuel supply, said connection channel including a check valve.

7. The carburetor improvement of claim 6 also including a check valve in said injection channel between said branch channel and said injection restrictor, and wherein said acceleration pump includes a fuel supply check valve and wherein said injection channel check valve is oriented to be closed when said fuel supply check valve and said connection channel check valve are open.

8. The carburetor improvement of claim 6 wherein said biasing means is a spring and wherein said adjusting means includes means threaded in the wall of said accumulator for varying the compression of said spring.

9. The carburetor improvement of claim 8 wherein said adjusting means includes a shoulder on the inner end thereof, and wherein said spring is positioned between said shoulder and said diaphragm and encloses a portion of said screw.

10. The carburetor improvement of claim 6 wherein said defining means includes a screw adjustable as to length with respect to said diaphragm, said diaphragm abutting against said screw at the maximum deformation.

11. The carburetor improvement of claim 10 wherein said adjusting means includes means for supporting said screw, and wherein the length of said screw is adjustable as to length through said adjusting means.

12. The carburetor improvement of claim 10 also including a piston in said diaphragm chamber and means for mounting said piston on said diaphragm and wherein the abutment of said screw with a portion of said piston-mounting means limits the deformation of said diaphragm.

13. In a carburetor having a pump acting in conjunction with the throttle valve for injecting fuel into a fuel-air mixture chamber during acceleration, a method for controlling the amount of fuel injected during acceleration, comprising the steps of:

providing a fuel accumulation chamber in communication with the pump having a predetermined volume and a variable increased volume against a bias pressure;

filling said predetermined volume of said fuel accumulation chamber with fuel under the suction action of the pump;

increasing said volume against said bias pressure by diverting a portion of the fuel supplied by said acceleration pump during acceleration;

storing said diverted portion of fuel in the increased volume under said bias pressure; and automatically injecting fuel into the fuel-air mixture chamber from said fuel accumulation chamber by the return of said increased volume to said predetermined volume under said bias pressure when said pressure exceeds the force of said pump.

14. The method of claim 13 also including the step of limiting the amount of increase of said volume.

15. The method of claim 12 including the step of adjusting said bias pressure.

16. The method of claim 13 including the step of controlling the proportion of the amount of fuel diverted.

17. The method of claim 16 wherein the step of controlling the proportion of the amount of fuel diverted includes the step of restricting the area through which the fuel is injected into the fuel-air mixture chamber, restricting the area through which the diverted fuel enters the predetermined volume, and adjusting the force of said bias.

* * * * *